US007622187B2

(12) United States Patent
Clarke et al.

(10) Patent No.: US 7,622,187 B2
(45) Date of Patent: Nov. 24, 2009

(54) ADHERED ROOF STRUCTURE

(75) Inventors: Steven R. Clarke, Mt. Holly Springs, PA (US); Michael J. Scanish, Camp Hill, PA (US); Robert C. Shiffer, Carlisle, PA (US)

(73) Assignee: Carlisle Intangible Company, Syracuse, NY (US)

( * ) Notice: Subject to any disclaimer, the term of this patent is extended or adjusted under 35 U.S.C. 154(b) by 1 day.

(21) Appl. No.: 11/463,905

(22) Filed: Aug. 11, 2006

(65) Prior Publication Data

US 2008/0038548 A1 Feb. 14, 2008

(51) Int. Cl.

| | |
|---|---|
| ***B32B 7/12*** | (2006.01) |
| ***B32B 3/26*** | (2006.01) |
| ***E04C 1/00*** | (2006.01) |
| ***E04B 5/00*** | (2006.01) |

(52) U.S. Cl. ..... 428/343; 428/304.4; 428/354; 52/309.4; 52/309.5; 52/408

(58) Field of Classification Search ..... 428/304.4, 428/343, 354; 52/408, 309.4, 309.5
See application file for complete search history.

(56) References Cited

U.S. PATENT DOCUMENTS

| | | | | |
|---|---|---|---|---|
| 4,996,812 | A | 3/1991 | Venable | |
| 5,095,068 | A | 3/1992 | Chiu | |
| 5,872,203 | A | 2/1999 | Wen et al. | |
| 5,951,796 | A * | 9/1999 | Murray | 156/78 |
| 6,130,268 | A | 10/2000 | Murray | |
| 6,679,018 | B2 | 1/2004 | Georgeau et al. | |
| 6,742,313 | B2 | 6/2004 | Ritland et al. | |
| 6,938,386 | B2 | 9/2005 | Ritland et al. | |

OTHER PUBLICATIONS

International Search Report and Written Opinion of the International Searching Authority, mailed Nov. 15, 2007.

* cited by examiner

*Primary Examiner*—Victor S Chang
(74) *Attorney, Agent, or Firm*—Wood, Herron & Evans, L.L.P.

(57) ABSTRACT

A membrane roof includes a supporting substrate covered with a roofing membrane. The roofing membrane is adhered to the substrate utilizing an adhesive such as a foam polyurethane adhesive. The adhesive has an elongation of at least 100% and a modulus no greater than 100 psi.

6 Claims, 1 Drawing Sheet

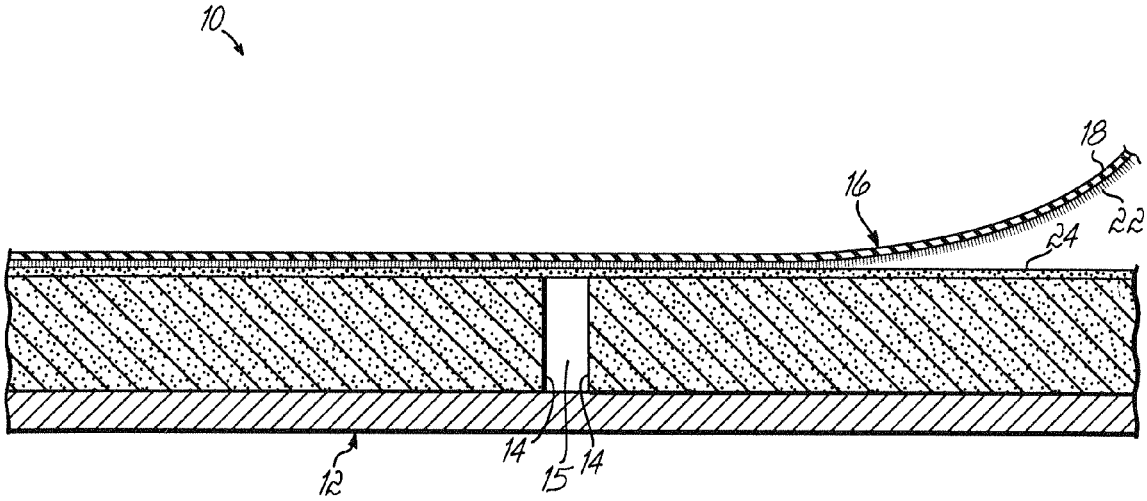
10
18
16
22
24
14
15
14
12

ADHERED ROOF STRUCTURE

BACKGROUND OF THE INVENTION

Membrane roofs utilize a membrane formed from polymers such as ethylene propylene diene monomer rubber (EPDM), thermoplastic olefin (TPO) or polyvinyl chloride (PVC) as a waterproof barrier. The membrane must be held on the roof in some way. There are a variety of different methods to do this including ballast (i.e., gravel), mechanical fasteners, and adhesives. The present invention relates to such membrane roofs fastened with adhesives.

There are a variety of different systems that have been employed utilizing different adhesives. One such system is disclosed in Venable U.S. Pat. No. 4,996,812. This patent discloses a foam polyurethane adhesive used to adhere a membrane to a roof structure. The membrane is a laminate having a fleece side and a polymeric membrane side. The fleece material improves adhesion between the membrane and the roof structure.

Another system is disclosed in Ritlin U.S. Pat. No. 6,742,313 which utilizes a very similar foam adhesive that is polyurea based. Other types of adhesives are used in addition to polyurethane adhesives and polyurea adhesives, such as thermoplastic adhesives and many different types of thermosetting adhesives.

The polyurethane and polyurea adhesives generally preferred are those with low elongation and high modulus. These adhesives are intended to provide high uplift resistance.

SUMMARY OF THE INVENTION

The present invention is premised on the realization that a low-modulus, high-elongation foam adhesive can be used to bond a roof membrane to a roof surface while maintaining good uplift resistance. Thermosetting and thermoplastic adhesives generally preferred are those with high elongation and lower modulus. These adhesives provide good uplift resistance but greater resistance to shear and fracture of some building movement.

The objects and advantages of the present invention will be further appreciated in light of the following detailed description and drawings, in which:

BRIEF DESCRIPTION OF THE DRAWING

The FIGURE is a cross sectional view partially broken away of a roof structure utilizing the present invention.

DETAILED DESCRIPTION OF THE INVENTION

As shown in the FIGURE, an exemplary roof structure 10 includes a supporting surface 12 covered with insulating foam panels 14. As shown, there is a slight gap 15 between the foam panels. The roofing membrane 16 in this embodiment has an outer polymeric surface 18 and an inner fleece or fibrous layer 22. An adhesive 24 is utilized to adhere the membrane 16 to the foam panels 14 which are mechanically attached to the surface 12.

For use in the present invention a wide variety of different membranes can be used, either with or without a fleece layer. These can be thermoplastic membranes such as polyvinyl chloride, or thermoplastic olefin, as well as EPDM. One preferred membrane is an EPDM membrane having a fleece layer. The manufacture of this product is disclosed in Venable U.S. Pat. No. 5,620,554, the disclosure of which is hereby incorporated by reference.

Many different foam adhesives can be used, including thermoplastic adhesives and thermoset adhesives. The type of adhesive is generally dictated by compatibility with the selected membrane and insulation substrate.

Regardless of the type of adhesive, the adhesive must have an elongation of greater than 100%, preferably at least 150%, up to 500%. Further, the adhesive must have a modulus from the range of 10 to about 100 psi at 150% elongation with about 20 psi preferred. For purposes of the present invention, elongation and modulus are measured by ASTM D412 tensile strength.

Such an adhesive will have adequate adhesion and will flex to provide localized stress release. Further, such an adhesive will bridge spaces, such as gap 15 at the insulation joint shown in the FIGURE, and compensate for movement in the joint due to building movement, thermal expansion and contraction, and roof top traffic.

A polyurethane adhesive is one preferred type of adhesive. Polyurethane adhesives can be applied as either one-part or two-part adhesives with two-part polyurethane adhesives being preferred for ease of application. These are applied as a low viscosity material which quickly foams and increases in viscosity subsequent to application and sets relatively quickly.

With respect to polyurethane adhesives, the modulus and elongation are controlled by selection of the appropriate polyol and isocyanate prepolymer. Generally, by selecting a higher molecular weight polyol, one increases the elongation and reduces the modulus. Generally, a polyol with a nominal molecular weight of at least about 3000 is preferred with about 4000 molecular weight most preferred. Higher molecular weight polyols, such as 6000 molecular weight polyols, can be used, if the viscosity is within limits of the application equipment.

With respect to the isocyanate prepolymer, it is preferred to have a reduced isocyanate (NCO) content. An isocyanate prepolymer with 27% NCO forms an adhesive that is too rigid. The isocyanate content should be above 16% in order to ensure proper curing. Generally, the NCO content should be greater than 20 and less than 25, with about 23-22.5% preferred. Again, both of these components lead to larger molecules which provides greater elongation. Further, the reduction in the amount of isocyanate reactive sites reduces the modulus.

In these formulations, it is generally preferred to have an index of about 1, meaning that there are an equal number of alcohol groups and isocyanate groups.

A preferred two-component polyurethane formulation is set out below.

TABLE

| | | % |
|---|---|---|
| Part B | | |
| Voranol 222-029 | Polyol | 69.00 |
| Dipropylene Glycol | Chain Extender | 5.50 |
| Fyrol PCF | Fire Retardant | 17.00 |
| Niaxx L6900 | Surfactant | 1.00 |
| Water | Blowing Agent | 4.50 |
| Dabco 33LV | Catalyst | 1.00 |
| DMEA | Catalyst | 2.00 |
| | | 100.00 |
| Part A | | |
| Surprasec 9465 | Isocyanate Prepolymer | 100.00 |

This formulation provides an adhesive with an elongation of about 200% and a 150% modulus of about 20 psi.

With respect to thermoplastic adhesives, the elongation and modulus are controlled by selecting the appropriate polymer as well as additives, such as plasticizers and the like.

To form the roof structure of the present invention, the roof is assembled as specified per the architect. There will be an outermost surface which, as shown in the FIGURE, is an insulation board product 14. Alternately, this could be a concrete surface, plywood, particle board, metal, or foam-covered metal. The adhesive 24 is applied directly to this supporting surface. If a two part adhesive is applied, an apparatus such as that described in Venable U.S. Pat. No. 4,996,812 can be employed. This apparatus mixes the two parts together on site. This mixture is sprayed onto the surface, and allowed to foam and react. The membrane 16 is then applied over the adhesive 24 with the fleece side 22 down, and the overlapping seams are subsequently adhered together using typical roofing adhesives.

This structure provides many benefits. Because of the elongation of the adhesive, it can cover gaps 15 of up to ½ inch that may occur between adjacent support structures such as adjacent insulation panels, as shown in the FIGURE. Further, it retains its elasticity over a longer period of time, thus retaining its ability to distribute the load over the roof surface. The low modulus of the adhesive provides localized stress release, yet the adhesive remains strong enough to bond the roof membrane to the roof and withstand substantial wind uplift forces typically incurred on a roof structure.

This has been a description of the present invention along with the preferred method of practicing the present invention. However, the invention itself should only be defined by the appended claims.

We claim:

1. A roof structure comprising a roof membrane and a roof substrate, a first surface of said membrane adhered to said substrate by a foaming polyurethane adhesive, said adhesive having an elongation of at least about 100% and a modulus less than about 100 psi at 150% elongation;

wherein said polyurethane is formed from a polyol and an isocyanate prepolymer and wherein said polyol has a molecular weight of at least about 3000; and wherein said isocyanate prepolymer has an isocyanate content of no greater than about 25% by weight.

2. The roof structure claimed in claim 1 wherein said first surface is a fibrous mat.

3. The roof structure claimed in claim 1 wherein said membrane is selected from the group consisting of polyvinyl chloride, thermoplastic olefin and EPDM.

4. The roof structure claimed in claim 1 wherein said adhesive has an elongation of at least about 150%.

5. The roof structure claimed in claim 4 wherein said adhesive has a modulus of 10 psi to about 100 psi at 150% elongation.

6. The roof structure claimed in claim 5 wherein said adhesive has a modulus of about 20 psi at 150% elongation.

* * * * *